United States Patent [19]

Downing

[11] Patent Number: 4,936,485

[45] Date of Patent: Jun. 26, 1990

[54] MANUALLY OPERATED MARKER DISPENSER

[76] Inventor: Donald M. Downing, 4408 S. 44th W. Ave., Tulsa, Okla. 74107

[21] Appl. No.: 308,114

[22] Filed: Feb. 8, 1989

[51] Int. Cl.[5] ..... B65G 59/06

[52] U.S. Cl. ..... 221/297; 404/93; 221/185

[58] Field of Search ..... 404/15, 73, 93, 94; 221/185, 289, 297, 223, 221, 299; 156/71, 574, 575, 578; 403/388

[56] References Cited

U.S. PATENT DOCUMENTS

| | | | |
|---|---|---|---|
| 3,284,103 | 11/1966 | Polzin et al. | 403/338 X |
| 3,540,358 | 11/1970 | Oakley | 404/94 X |
| 3,864,052 | 2/1975 | Blomberg | 404/94 |
| 4,436,222 | 3/1984 | Taylor et al. | 221/223 |

*Primary Examiner*—Jerome W. Massie, IV
*Assistant Examiner*—Matthew Smith
*Attorney, Agent, or Firm*—Head & Johnson

[57] ABSTRACT

A manual marker dispenser for road markers which is supported from a wheel mounted adhesive applicator which deposits small amounts of adhesive at selected spaced positions along a roadway. The dispenser has an upright cage member in which the markers are placed which typically has measurements of four inches by four inches by about three feet. The cage is open at the top and bottom and at the bottom there are two release cams spaced on opposite sides of the dispenser. The cams are essentially cylindrical in shape with about a quarter of the cylinder removed in a V-shaped pattern. Handle and linkage are provided to rotate the cams from a first position where the markers rest on the cam to a second position where the cut-away portion lets the markers drop out of the cage.

4 Claims, 6 Drawing Sheets

MANUALLY OPERATED MARKER DISPENSER

BACKGROUND OF THE INVENTION

This invention relates to an apparatus for placing road markers on the surface of a roadway at selected locations.

This country is criss-crossed by hundreds of thousands of miles of highways. Most of these roads have some markings on the surface such as painted lines to denote the center of the highway on two-lane roads and to denote the lines on four or more lane divided highways. Sometimes the lines are painted to show where the edge of the road is. These paintings are of course quite helpful. However, the paint does tend to wear away and sometimes it is difficult to see the paint on a rainy, dark night. One method of marking roads which for some areas replaces the painted lines, is the securing of reflectors to the roadway at selected locations. These reflectors are extremely helpful to motorists on dark, rainy nights inasmuch as they show the driver where the roadway actually is.

There have been numerous ways of securing these reflectors to the surface of the roadway. One common way is to apply an epoxy at selected spaced locations along the roadway and then place the reflectors in the epoxy puddle and let the epoxy cure. A more recent and less expensive way of depositing an adhesive to the road way is a thermal adhesive applicator which deposits bitumen on selected locations along the road and has been developed by Downing Manufacturing Company, 4525 South 34th West Ave., Tulsa, OK. Its model PD-1001 is a hand pushed thermal adhesive applicator and its model PD-2001 is a tractor pull model which is a new self-contained thermal adhesive applicator. In that latter application a heater heats the bitumen contained in a vat to about 425° F. where it becomes a liquid and can be pumped. The temperature is thermostatically controlled. A stir is provided and may be either hand operated or driven by a motor. The vat has an outlet which is attached to a pump assembly. An operator is positioned to one side of the frame of the trailer and an articulated conduit extension outlet of the pump assembly to a bitumen dispensing valve which has an upstanding handle which can be grasped by the operator. An operator rides on the applicator and dispenses the hot liquid bitumen at the correct spot. Thereafter, a worker manually takes a single reflector or marker in his hand and then places it in the hot puddle. If he doesn't drop it just right where it is essentially level, he must step on it with his foot to position it properly.

It is thus an object of this invention to provide a marker and/or reflector dispenser which will drop the markers at a level position on a puddle of adhesive.

SUMMARY OF THE INVENTION

This is a manually operated road marker dispenser system. An elongated square cage which may be attached to a commercially available thermal adhesive applicator is provided. The cage has an open top and an open bottom and is sized to receive road markers and/or reflectors stacked like pancakes therein. The lower end of the cage is provided with two parallel cam releases which are on opposite side of the end of the cage. The cam releases are cylinders in which a V-shaped notch has been cut out along the full longitudinal length. A handle is connected to leverage means which rotates the release cams. In one position the lowermost marker rests on one face of the V notch of the release cam. When the handle is moved it causes the cams to rotate so that the marker drops out of the V notch onto an adhesive puddle.

The cage is mounted on a wheel mounted applicator in such a position that the lower end of the cage is very close to the road way. The marker or reflector when released are level and will drop squarely onto the puddle of adhesive.

DETAILED DESCRIPTION

Figure 1:
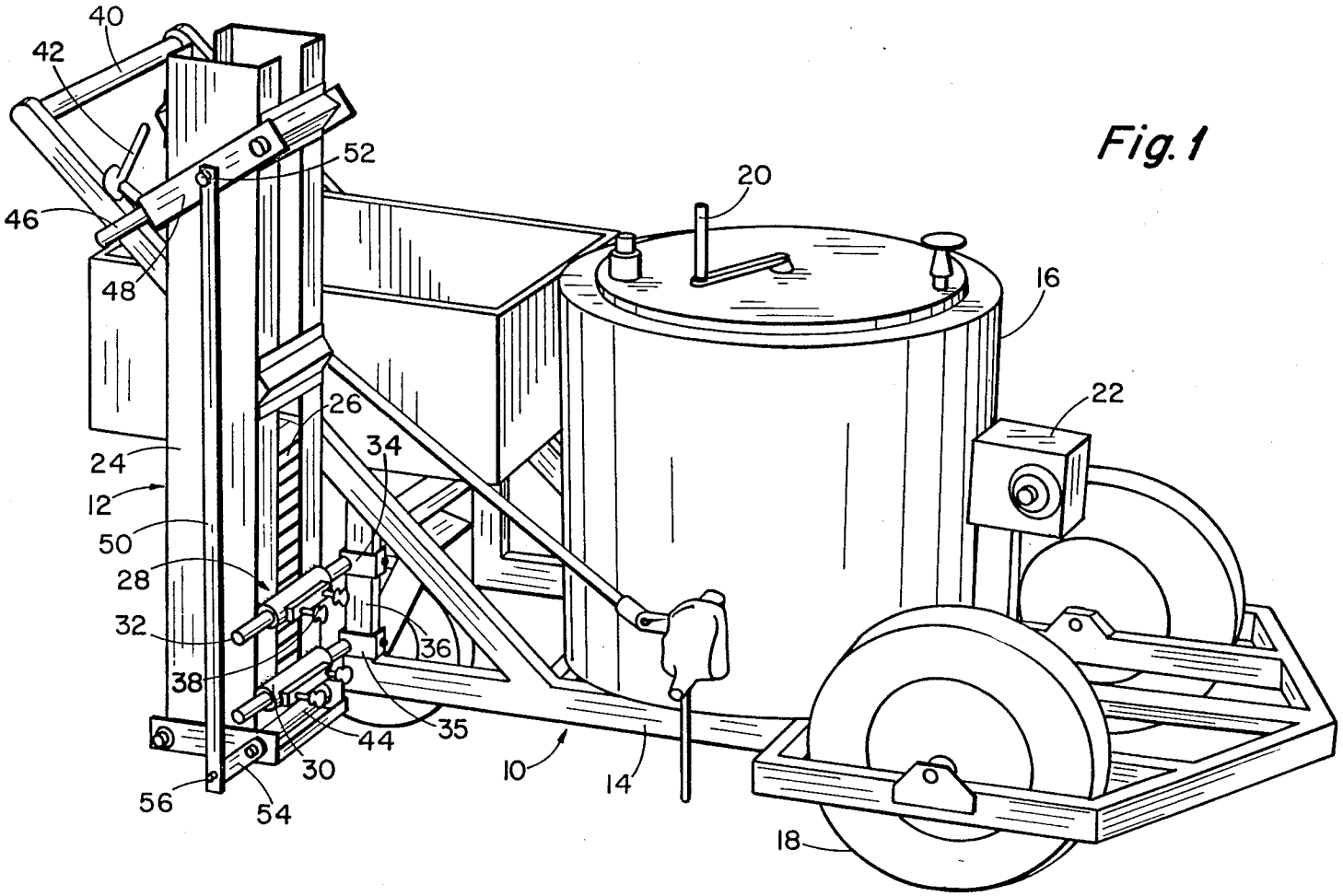
FIG. 1 is an isometric view showing my manually operated marker dispenser mounted on a thermal adhesive applicator.

Shown in FIG. 1 is a thermal adhesive applicator 10 upon which my manually operated marker dispenser 12 is mounted. The adhesive applicator includes a frame 14 supported by wheels 18 and a vat 16 upon the frame. A stir handle 20 is shown on top of the vat and a control unit 22 is provided to control the heating of the vat. The thermal adhesive applicator also has a push handle 40 so that the unit may be pushed manually and an actuator 42 so that a glob or puddle of hot adhesive can be dispersed to the roadway at the proper location. This adhesive applicator can typically be a model PD-1001 manufactured by the Downing Manufacturing Company, 4525 South 34th West Ave., Tulsa, Okla. However, my marker dispenser 12 can be used on other models.

My marker dispenser 12 is shown mounted on the right hand side of the applicator. However, it could as easily be mounted on the left hand side. My marker dispenser includes a cage 24 in which markers 26 are stacked one on top of the other. The cage 24 is provided with an upper anchor tube 28 and a lower anchor tube 30. Anchor tube 28 has a support rod 32 extending through the anchor tube 28 and the support rod 32 has a support bracket 34 for attaching to frame member 36 of the frame of the thermal adhesive applicator. Set screws 38 hold the support rod in position. The anchor tube 30 also has a similar support rod, support bracket 35 and set screws. One can readily mount this on the opposite sides by releasing the set screws 38, removing the support rod 32 from the anchor tube 28 and inserting it from the opposite end. In that way, the support bracket 34 will extend out in the proper direction so that it can be mounted on the left hand side.

Figure 2:
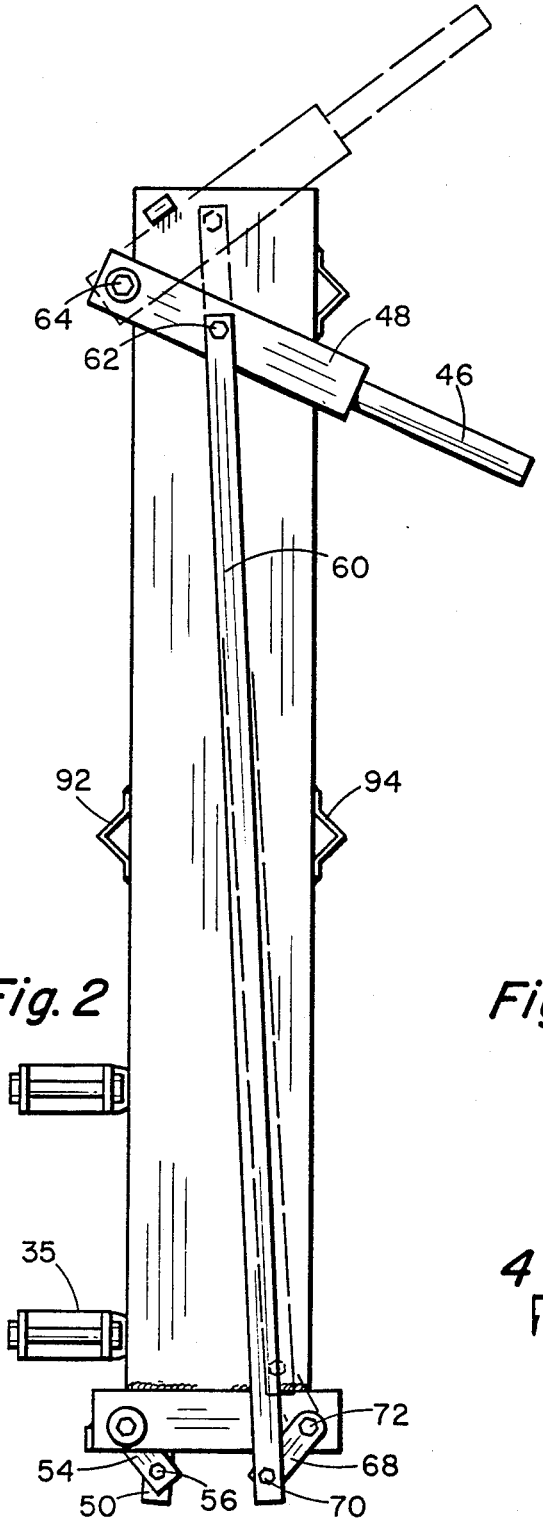
FIG. 2 illustrates a side view of my marker dispenser.
Figure 3:
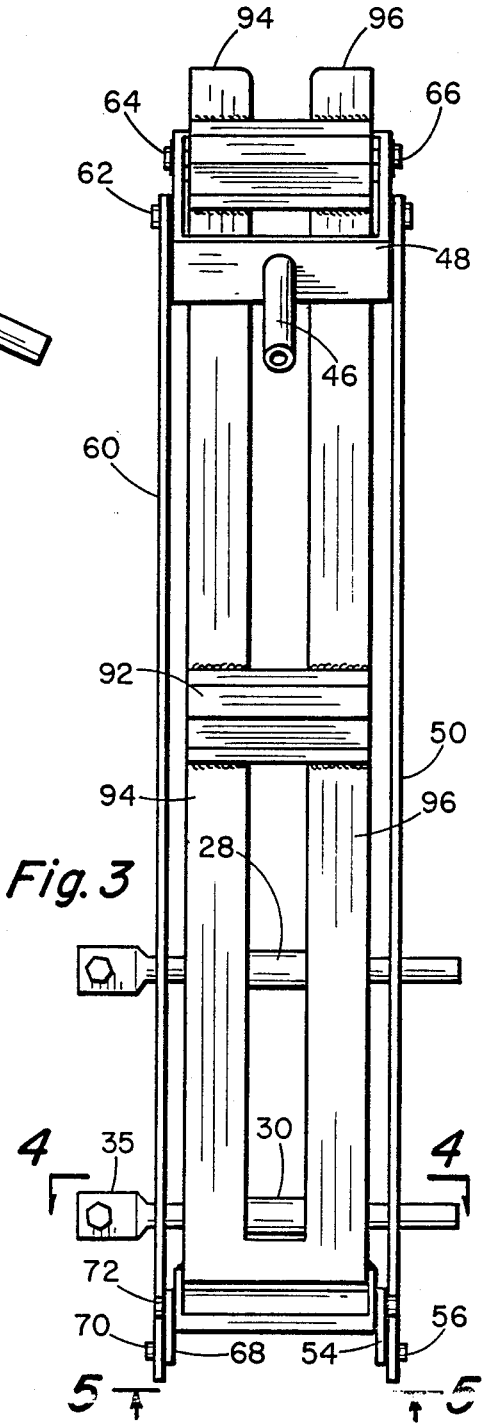
FIG. 3 is a side view of my marker dispenser in which the view is rotated ninety degrees from that of FIG. 2.
Figure 4:
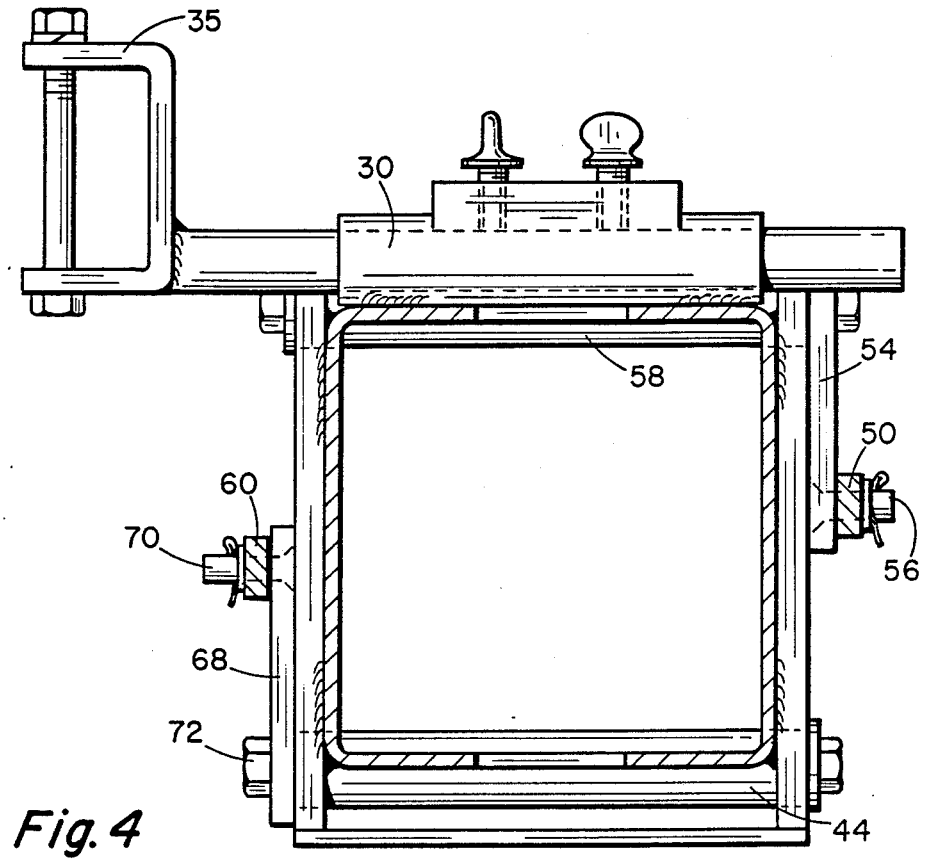
FIG. 4 is a view taken along the line 4—4 of FIG. 3.
Figure 5:
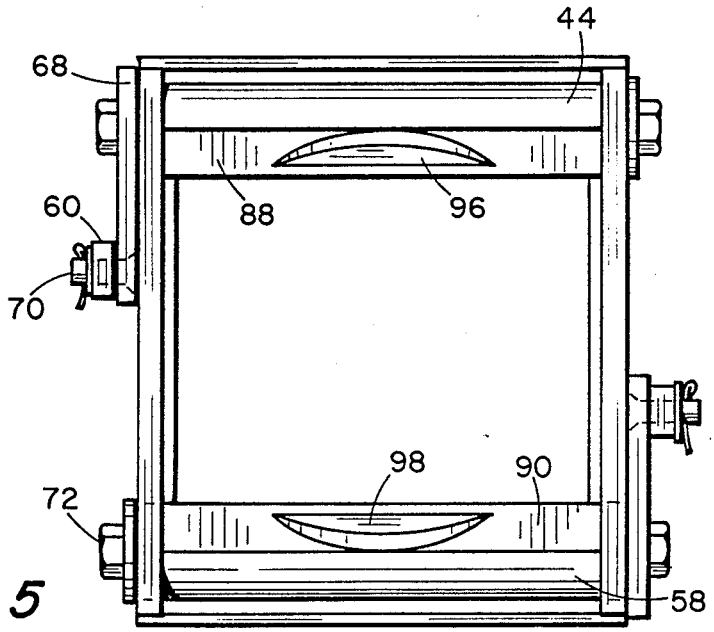
FIG. 5 is a view taken along the line 5—5 of FIG. 3.
Figure 13:
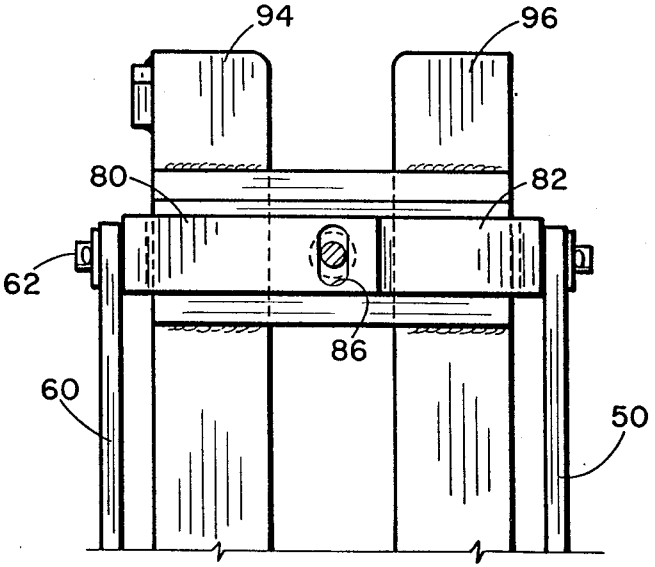
FIG. 13 is a view taken along the line 13—13 of FIG. 12.
Figure 12:
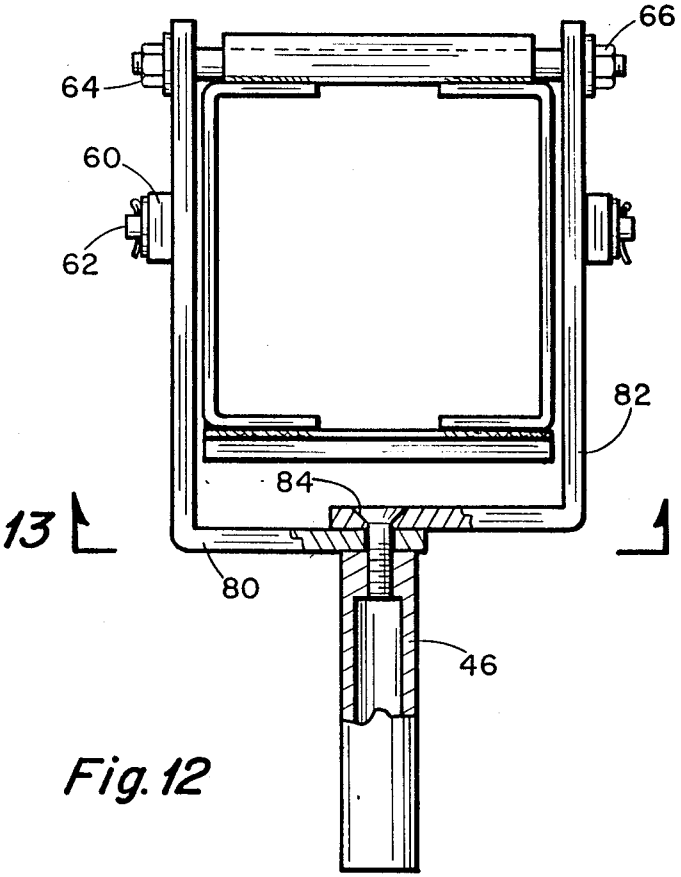
FIG. 12 is a top view of my dispenser with a portion of the handle cut away.

The marker dispenser has release cams 44 and 58 (FIGS. 4 and 5) The means for rotating the release cams includes a handle 46 connected to U-shaped control bar 48 which operates connector bar 50 to which it is pivotally attached at 52 to rotate pivot bar 54 to which it is pivotally attached at 56. The pivot bar 54 is fixed to release cam 44 so that movement of the pivot bar 54 rotates the cam. A shown in FIGS. 2 and 3 there is a similar linkage on the other side of the cage. This includes a connector bar 60 pivotally connected at 62 to control bar 48. The control bar is U-shaped as shown in FIG. 3 and is pivotally mounted at pivots 64 and 66. Connector bar 60 is pivotally connected at 70 to pivot bar 68 which is secured or fixed to cam 58 so that rotation of pivot bar 68 rotates cam 58. As shown in FIGS. 12 and 13 handle 48 is made in two L-shaped pieces, section 80 and 82 with a long leg and a short leg. Section 80 has a hole 84 extending therethrough and the hole through section 82 is an elongated hole 86 which is useful in adjusting the left and right hand side of the linkage mechanism connection to the handle so that the linkage will operate smoothly and have a smooth action for rotating the release cams. FIGS. 4 and 5 aid in showing how the linkage mechanism is connected to the cam release roller 44 and 58. In these FIGURES the clamps and handles are not shown to improve the clarity. As clearly shown in FIGS. 4 and 5 each of the rollers 44 and 58 have release notches 88 and 90, respectively.

Strengthening or support members 92 and 94 are provided to rigidly secure the two sides 94 and 96 of the cage. Crescent shaped cavities 96 and 98, respectively are in release notch 88 and 90 of cams 44 and 58.

Figure 6:
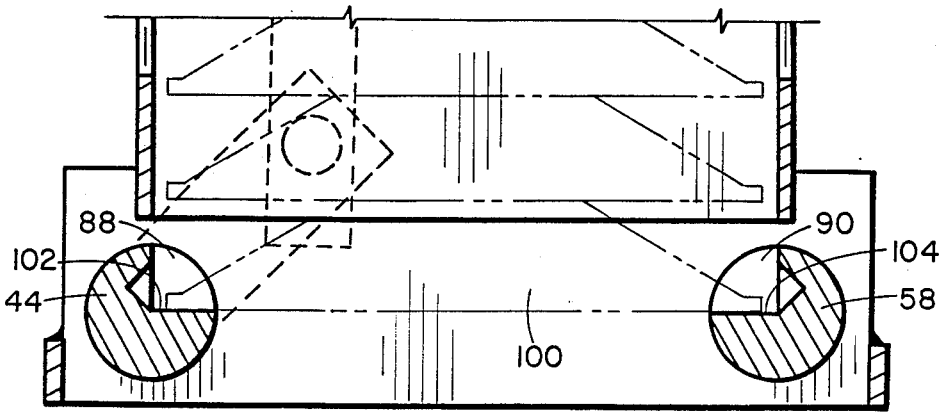
FIG. 6 illustrates the V-notch of my cam release supporting a series of markers.
Figure 7:
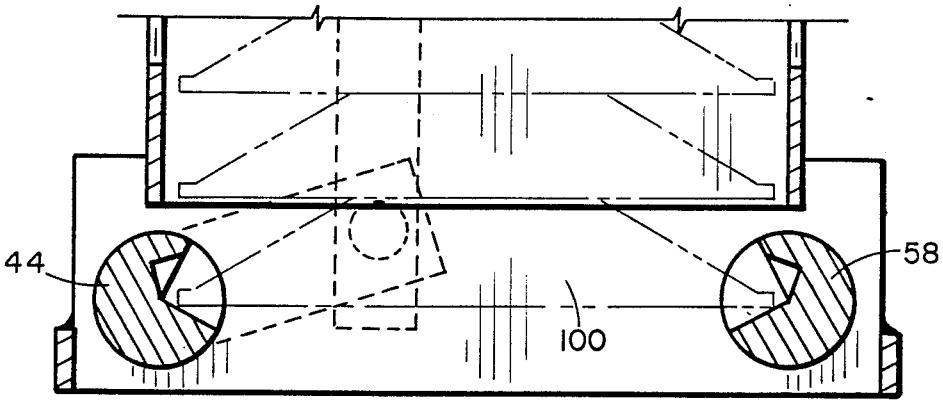
FIG. 7 is similar to FIG. 6 except that the cams have been slightly rotated.
Figure 8:
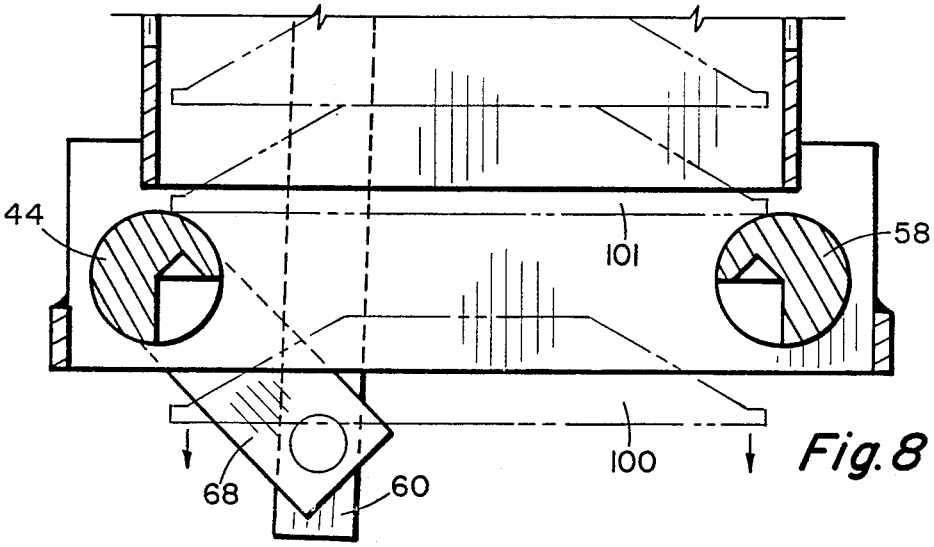
FIG. 8 is similar to FIG. 7 except that the cams have been rotated to where the V-notch releases the road marker.

Attention is next directed to FIGS. 6, 7 and 8 which shows the sequence of operations of the release cams to release and drop a square reflector or marker. As shown in FIG. 6 a marker 100 rests on shoulders 102 and 104 of notches 88 and 90 of release cams 44 and 58. When the release cams are in the position shown in FIG. 6 the marker 100 merely rests on the shoulders as indicated. When it is desired to lower a marker the handle 46 is moved to the position shown in FIG. 6 and this permits the marker 100 to rest on the shoulders as shown. Continuing lowering of handle 46 causes the cams to reach the position shown in FIG. 7 and when the cam has been rotated to the point shown in FIG. 8 the lowermost marker is free to drop onto the previously deposited adhesive which if used in the device of FIG. 1 would be molten bitumen. As can be seen in FIG. 8 the next upper marker 101 is now resting on the top round portion of the release cams. It is then ready for the next sequence of operations in which the handle would be raised to the position shown in FIG. 6 so that another marker 101 could drop into position as shown in FIG. 6 and the sequence can be repeated as often as desired. The cams are sized such that only one marker at a time can be dropped. As the cam is dropping one marker the next upper marker will rest on the round portion of the cam.

Figure 9:
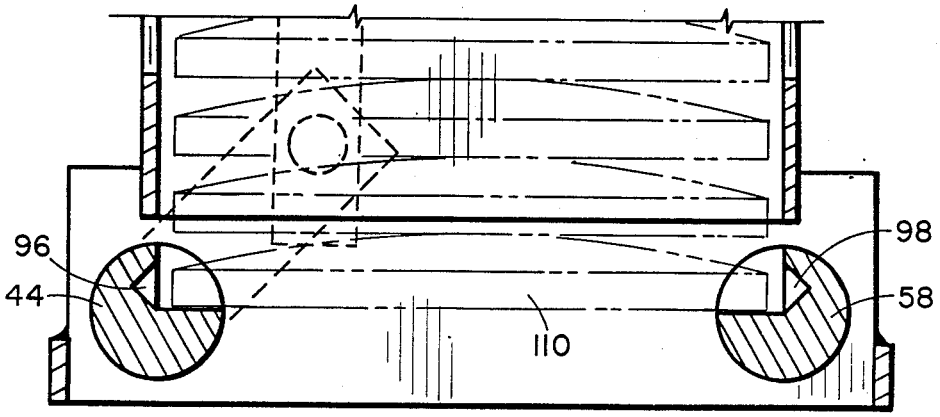
FIGS. 9, 10 and 11 are similar to FIGS. 6, 7 and 8, respectively, except that there are round markers supported in the cage.
Figure 10:
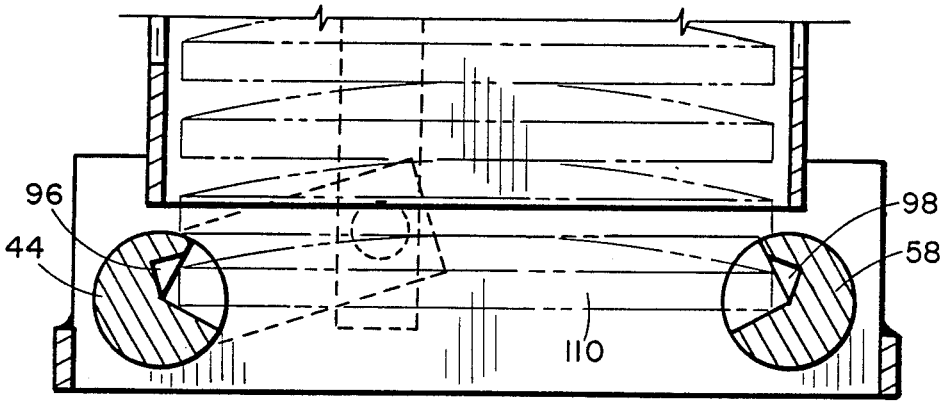
Figure 11:
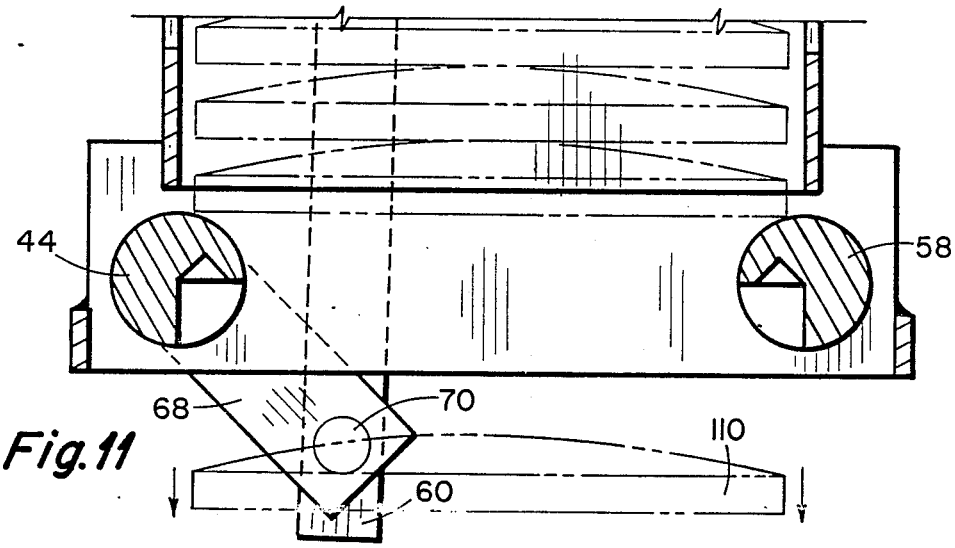

Attention is next directed to FIGS. 9, 10 and 11 which shows a sequence when using a round marker which is normally thicker around its perimeter than is the edges of a typical square marker illustrated in FIGS. 6, 7 and 8. To accommodate this extra thickness there are crescent shaped notches 96 and 98 in release cams 44 and 58. In the sequence of operations as indicated by the positions in FIG. 9 the handle 46 has been lifted and round marker 110 has dropped onto the shoulders 102 and 104 similarly as did the square marker 100. Continued lowering of the handle 46 causes rotation of the cams as shown in FIG. 10. Here the edge of the round marker 110 is thicker than that indicated for the square marker 100. The crescent shaped recesses 96 and 98 permit the release cams used with the square markers to work with a round unit having thicker edges than the edges of the square markers illustrated in FIGS. 6, 7 and 8. The crescent shaped cut-outs permit a part of the round marker to "clear" by entering the crescent shaped notch whereas without this notch the unit would not function. It is to be noted that for most commercially available circular markers that those markers are thicker at the edge around the periphery than are the edges of most commercial square-type reflectors indicated in FIGS. 6, 7 and 8.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What I claim is:

1. A manually operated pavement marker dispenser which comprises:

a vertically elongated cage for storing a plurality of stacked pavement markers right side up having an open top end and open bottom end, each said open end having four sides forming an opening with opposite sides being parallel;

first and second spaced and parallel release cylindrical cams rotatably mounted on opposite sides adjacent and inside said bottom end, each said cylindrical cam having a longitudinal notch cut the full length of such cylinder said notches facing each other in a first position retaining a marker;

a handle mounted adjacent the first open end thereof;

linkage means interconnecting said handle to said first and second cylindrical cam so that a first actuation of said handle inwardly rotates said first and second cams to a second position whereby said marker will release from said notches and gravity drop to the pavement while the next adjacent pavement marker rests against an unnotched portion of said cylindrical cam, while a second actuation of said handle returns said cam to said first position.

2. A manually operated marker dispenser as defined in claim 1 in which each said first and second cylindrical cams are further characterized by having a crescent shaped clearance cut-out in one face of the notch of each said cylinder.

3. A manually operated marker dispenser as defined in claim 1 in which said handle includes a U-shaped control bar member pivotally attached to said cage by two pivots and encircling three sides thereof and in which said linkage means includes a first connector bar pivotally attached to said control bar member between the pivot and the handle a first pivot bar rigidly attached to said first release cylindrical cam and pivot means connecting one end of said first connector bar and one end of said pivot bar;

a second connector bar connected at one end to said control bar member on the opposite sides from said connector bar;

a second pivot bar rigidly attached to said second release cylindrical cam and a pivot connecting said second connector bar and said second pivot bar.

4. A manually operated marker dispenser as defined in claim 3 in which said control bar includes two L-shaped members which are connectable to form a U-shaped member and in which each L-shaped member has a long leg and a short leg and which the first short leg of one L-shaped member has a hole therein and the second short leg of the second L-shaped member has a slot therethrough, and a bolt which extends through said slot and said holes to secure the two L-shaped members together.

* * * * *